US006744342B2

(12) United States Patent
Decristofaro et al.

(10) Patent No.: US 6,744,342 B2
(45) Date of Patent: Jun. 1, 2004

(54) HIGH PERFORMANCE BULK METAL MAGNETIC COMPONENT

(76) Inventors: Nicholas J. Decristofaro, 33 Lincoln Ave., Chatham, NJ (US) 07928; Gordon E. Fish, 103 Lorraine Ave., Upper Montclair, NJ (US) 07043

( * ) Notice: Subject to any disclaimer, the term of this patent is extended or adjusted under 35 U.S.C. 154(b) by 329 days.

(21) Appl. No.: 09/911,355

(22) Filed: Jul. 23, 2001

(65) Prior Publication Data

US 2003/0201864 A1 Oct. 30, 2003

Related U.S. Application Data

(60) Provisional application No. 60/221,035, filed on Jul. 27, 2000.

(51) Int. Cl.[7] ..... H01F 3/00
(52) U.S. Cl. ..... 335/297; 336/234
(58) Field of Search ..... 335/296, 297; 336/233, 234

(56) References Cited

U.S. PATENT DOCUMENTS

| | | | | |
|---|---|---|---|---|
| 4,257,830 | A | 3/1981 | Tsuya et al. | 148/112 |
| 4,265,682 | A | 5/1981 | Tsuya et al. | 148/112 |
| 4,672,346 | A | 6/1987 | Miyamoto et al. | 335/296 |
| 4,818,966 | A | 4/1989 | Miyamoto et al. | 335/296 |
| 4,827,235 | A | 5/1989 | Inomata et al. | 335/297 |
| 4,865,657 | A | 9/1989 | Das et al. | 148/113 |
| 4,990,197 | A | 2/1991 | Das et al. | 148/307 |
| 5,089,061 | A | 2/1992 | Abe et al. | 148/110 |
| 5,124,651 | A | 6/1992 | Danby et al. | 324/318 |
| 5,283,544 | A | 2/1994 | Sakurai et al. | 335/297 |
| 5,489,342 | A | 2/1996 | Arai et al. | |

FOREIGN PATENT DOCUMENTS

| | | |
|---|---|---|
| EP | 0 367 144 | 5/1990 |
| GB | 1 326 766 | 8/1973 |
| JP | 56 012705 | 4/1981 |
| JP | 09 275021 | 1/1998 |
| JP | 10 121212 | 8/1998 |
| WO | WO 00/28556 | 5/2000 |

*Primary Examiner*—Ramon M. Barrera
(74) *Attorney, Agent, or Firm*—Ernest D. Buff and Associates, LLC; Ernest D. Buff; Gordon E. Fish

(57) ABSTRACT

A high performance bulk magnetic component includes a plurality of layers of crystalline, ferromagnetic metal strips adhesively bonded together to form a polyhedrally shaped part. When the component is excited at an excitation frequency "f" to a peak induction level $B_{max}$, it exhibits a core-loss less than "L" wherein L is given by the formula $L=0.0135\ f\ (B_{max})^{1.9}+0.000108\ f^{1.6}\ (B_{max})^{1.92}$, said core loss, said excitation frequency and said peak induction level being measured in watts per kilogram, hertz, and teslas, respectively. Performance characteristics of the high performance bulk magnetic component of the present invention are significantly better when compared to silicon-steel components operated over the same frequency range.

27 Claims, 5 Drawing Sheets

HIGH PERFORMANCE BULK METAL MAGNETIC COMPONENT

This application claims priority from U.S. Provisional Application No. 60/221,035 filed on Jul. 27, 2000.

BACKGROUND OF THE INVENTION

1. Field of the Invention

This invention relates to bulk magnetic components; and more particularly, to a generally three-dimensional high performance bulk metal magnetic component for large electronic devices such as magnetic resonance imaging systems, television and video systems, and electron and ion beam systems.

2. Description of the Prior Art

Certain steel alloys have long been used in magnetic devices in numerous technological applications. The most commonly used of these steels are low-carbon alloys and alloys with up to 3–3.5 weight percent silicon, often referred to as electrical steels and silicon steels, respectively. (As is conventional in the silicon steel art, the content of Si and other elemental additions recited herein is to be understood as a weight percentage unless otherwise specified.) These alloys find widespread use in electric motors, transformers, actuation devices, relays, and the like. Although steels are generally inexpensive, they are often unsuitable for demanding requirements. Among their most significant limitations are their core losses and their magnetostrictions. The low carbon steels are generally the least expensive alloys used for magnetic devices; they are widely available in commerce as unoriented sheet in thicknesses as low as 350 $\mu$m (0.014"). However, their core losses are high enough to preclude their use in most applications requiring high efficiency or excitation frequencies greater than line frequency (50–60 Hz). Somewhat lower losses are exhibited by the silicon-containing alloys. They are produced in vast quantities either as non-oriented or oriented sheets in thicknesses as low as 125–175 $\mu$m (0.005–0.007"). Oriented sheets have marked crystallographic texture that results in a substantial difference in their magnetic properties for excitation in different directions within the sheet. Oriented sheets are thus most suited for applications wherein flux is predominantly along a defined single direction including transformers and segmented components. Non-oriented materials are best suited to applications wherein the flux direction is not constant during operation, e.g. motor stators.

In addition to steels, other high induction, crystalline materials are known for use in certain magnetic applications, including Fe—Si—Al alloys like Sendust, Fe—Co alloys, and Fe—Ni alloys. In each of these alloy families, small additions of other elements may be added for the sake of metallurgical processing or enhancement of soft magnetic properties.

Magnetic resonance imaging (MRI) has become an important, non-invasive diagnostic tool in modern medicine. An MRI system typically comprises a magnetic field generating device. A number of such field generating devices employ either permanent magnets or electromagnets as a source of magnetomotive force. Frequently the field generating device further comprises a pair of magnetic pole faces defining a gap with the volume to be imaged contained within this gap.

The earliest magnetic pole pieces were made from solid magnetic material such as carbon steel or high purity iron, often known in the art as Armco iron. They have excellent DC properties but very high core loss in the presence of AC fields because of macroscopic eddy currents. Some improvement has been gained by forming a pole piece of laminated conventional steels.

U.S. Pat. No. 4,672,346 teaches a pole face having a solid structure and comprising a plate-like mass formed from a magnetic material such as carbon steel. U.S. Pat. No. 4,818,966 teaches that the magnetic flux generated from the pole pieces of a magnetic field generating device can be concentrated in the gap therebetween by making the peripheral portion of the pole pieces from laminated magnetic plates. U.S. Pat. No. 4,827,235 discloses a pole piece having large saturation magnetization, soft magnetism, and a specific resistance of 20 $\mu\Omega$-cm or more. Soft magnetic materials including permalloy, silicon steel, amorphous magnetic alloy, ferrite, and magnetic composite material are taught for use therein.

U.S. Pat. No. 5,124,651 teaches a nuclear magnetic resonance scanner with a primary field magnet assembly. The assembly includes ferromagnetic upper and lower pole pieces. Each pole piece comprises a plurality of narrow, elongated ferromagnetic rods aligned with their long axes parallel to the polar direction of the respective pole piece. The rods are preferably made of a magnetically permeable alloy such as 1008 steel, soft iron, or the like. The rods are transversely electrically separated from one another by an electrically non-conductive medium, limiting eddy current generation in the plane of the faces of the poles of the field assembly. U.S. Pat. No. 5,283,544, issued Feb. 1, 1994, to Sakurai et al. discloses a magnetic field generating device used for MRI. The devices include a pair of magnetic pole pieces which may comprise a plurality of block-shaped magnetic pole piece members formed by laminating a plurality of non-oriented silicon steel sheets.

Notwithstanding the advances represented by the above disclosures, there remains a need in the art for improved pole pieces. This is so because these pole pieces are essential for improving the imaging capability and quality of MRI systems. Although steel alloys are widely available, they have still been considered unsuitable for use in bulk magnetic components such as the tiles of poleface magnets for advanced magnetic resonance imaging systems (MRI), largely because of their high core losses under AC excitation.

It has also been known in the magnetic materials art that certain advantages might potentially be obtained by using silicon steels with considerably higher silicon content than the typical 3–3.5%. That limit is set by fundamental metallurgical constraints. An alloy with silicon content of greater than about 2.5% is said to have a closed $\gamma$ loop. That is, upon cooling an alloy with lower than 2.5% Si from high temperature, there is a series of successive allotropic transformations of the alloy from the body-centered cubic (bcc) $\delta$ crystallographic phase to the face-centered cubic (fcc) $\gamma$ phase and finally to the room-temperature bcc $\alpha$ phase. Instead, at higher Si the alloy remains bcc throughout. This allows a careful interplay of rolling operations and controlled grain growth essential for producing thin-gage, low core loss sheet stock. However, above about 4–4.5% Si there is another difficulty, namely the formation of $DO_3$ and $B_2$ phases which are characterized by superlattice ordering. The presence of the ordered $DO_3$ and $B_2$ phases results in brittleness, precluding normal rolling operations.

It has been recognized that alloys with 6–7% Si have certain attractive electromagnetic characteristics. The increased solute content increases the alloy's electrical resistivity, tending to improve the eddy current component of core loss. At about 6.5%, the magnetostriction of the alloy is nearly zero, reducing the susceptibility of the component to degradation of its magnetic properties by internally or externally imposed stresses. However, processing difficulties have meant that high silicon iron alloys are still not widely recognized or applied.

Several non-conventional methods have recently been taught for producing sheets of high silicon content Fe-base alloys. First, rapid solidification processing has been used to form directly thin strip material with high Si content. U.S. Pat. No. 4,265,682 to Tsuya et al. discloses a high silicon steel strip consisting of 4–10 weight % of Si and the remainder being substantially Fe and incidental impurities. The strip is produced by rapidly cooling a melt to form a microstructure comprising very fine crystal grains with substantially no ordered lattice. U.S. Pat. Nos. 4,865,657 and 4,990,197, each to Das et al., disclose heat treatment of a rapidly quenched Fe—Si containing 6–7 weight % Si to promote and control grain orientation and an order-disorder reaction.

Another method for producing sheets of high silicon content Fe-base alloys is disclosed in U.S. Pat. No. 5,089,061, which teaches subjecting steel strip to siliconization by chemical vapor deposition (CVD) from an atmosphere containing $SiCl_4$ and a subsequent diffusion treatment for diffusing Si uniformly through the steel strip.

Still another method is provided by U.S. Pat. No. 5,489,342, which discloses a method of manufacturing a silicon steel sheet having grains precisely arranged in the Goss orientation, the strip containing 2.5 to 7.0 weight % Si. Goss orientation is a crystallographic texture defined by (110) <001> preferred grain orientation.

SUMMARY OF THE INVENTION

Presented is a high performance bulk metal magnetic component having the shape of a polyhedron and being comprised of a plurality of layers of crystalline, ferromagnetic metal strips. Also provided by the present invention is a method for making a high performance, bulk metal magnetic component. The magnetic component is operable at frequencies ranging from about 50 Hz to 20,000 Hz and exhibits improved performance characteristics when compared to conventional silicon-steel magnetic components operated over the same frequency range. More specifically, a magnetic component constructed in accordance with the present invention and excited at an excitation frequency "f" to a peak induction level "$B_{max}$" may have a core loss at room temperature less than "L" wherein L is given by the formula $L=0.0135\ f\ (B_{max})^{1.9}+0.000108\ f^{1.6}\ (B_{max})^{1.92}$, the core loss, the excitation frequency and the peak induction level being measured in watts per kilogram, hertz, and teslas, respectively. In an embodiment the magnetic component may have (i) a core-loss of less than or approximately equal to 1 watt-per-kilogram of magnetic metal material when operated at a frequency of approximately 60 Hz and at a flux density of approximately 1.0 Tesla (T); (ii) a core-loss of less than or approximately equal to 20 watts-per-kilogram of magnetic metal material when operated at a frequency of approximately 1000 Hz and at a flux density of approximately 1.0 T, or (iii) a core-loss of less than or approximately equal to 105 watt-per-kilogram of magnetic metal material when operated at a frequency of approximately 20,000 Hz and at a flux density of approximately 0.30 T.

In one embodiment of the present invention, a high performance bulk metal magnetic component comprises a plurality of substantially similarly shaped layers of ferromagnetic metal strips having a high saturation induction and being laminated together by adhesive bonding to form a polyhedrally shaped part.

The present invention also provides methods of constructing a high performance bulk metal magnetic component. In one embodiment of the method, ferromagnetic high saturation induction metal strip material is cut to form a plurality of cut strips having a predetermined length. The cut strips are stacked to form a bar of stacked high saturation induction metal strip material which is impregnated with an epoxy resin and cured. The component is then cut in the requisite shape from the impregnated bar.

In another embodiment of the method, ferromagnetic high saturation induction metal strip material is wound about a mandrel to form a generally rectangular core having generally radiused corners. The core is then impregnated with epoxy resin and cured. The short sides of the rectangular core are then cut to form two magnetic components having a predetermined three-dimensional geometry that is the approximate size and shape of said short sides of said generally rectangular core. The radiused corners are removed from the long sides of said generally rectangular core and the long sides of said generally rectangular core are cut to form a plurality of polyhedrally shaped magnetic components having the predetermined three-dimensional geometry.

Yet another embodiment of the method includes the steps of stamping laminations in the requisite shape from ferromagnetic high saturation induction metal strip feedstock, stacking the laminations to form a three-dimensional shape, applying and activating adhesive means to adhere the laminations to each other forming a component having sufficient mechanical integrity, and finishing the component to remove any excess adhesive and to give it a suitable surface finish and final component dimensions. The method may further comprise an optional annealing step to improve the magnetic properties of the component. These steps may be carried out in a variety of orders and using a variety of techniques including those set forth in more detail hereinbelow.

The present invention is also directed to a bulk high performance metal component constructed in accordance with the above-described methods. In particular, high performance bulk metal magnetic components constructed in accordance with the present invention are especially suited for metal tiles for poleface magnets in high performance MRI systems; television and video systems; and electron and ion beam systems and other devices. The advantages afforded by the present invention include simplified manufacturing, reduced manufacturing time, reduced stresses (e.g., magnetostrictive) encountered during construction of high performance bulk metal components, and optimized performance of the finished magnetic component.

BRIEF DESCRIPTION OF THE DRAWINGS

The invention will be more fully understood and further advantages will become apparent when reference is had to the following detailed description of the embodiments of the invention and the accompanying drawings, wherein like reference numerals denote similar elements throughout the several views, and in which.

DETAILED DESCRIPTION

Figure 1A:
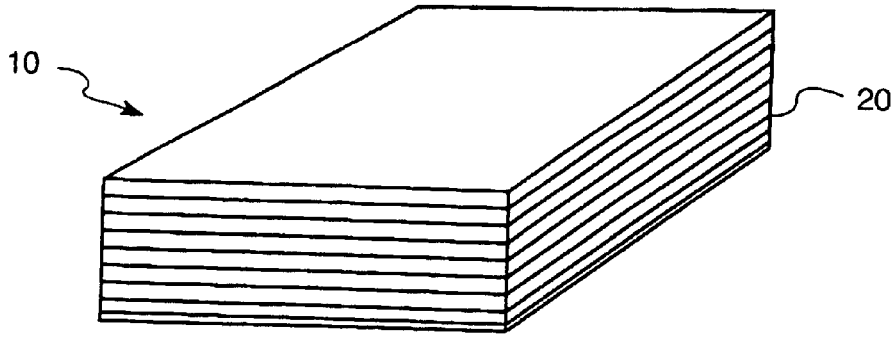
FIG. 1A is a perspective view of a high performance, bulk, high saturation induction metal magnetic component having the shape of a generally rectangular polyhedron constructed in accordance with the present invention.

In an implementation, a generally polyhedrally shaped, high performance, bulk ferromagnetic metal magnetic component is provided. Magnetic components may be constructed having various geometries including, but not limited to, rectangular, square, and trapezoidal prisms. In addition, any of the previously mentioned geometric shapes may include at least one arcuate surface, and may include two oppositely disposed arcuate surfaces to form a generally curved or arcuate bulk magnetic component. The crystalline, ferromagnetic metal used may be a high saturation induction alloy such as a high silicon iron or iron nickel alloy. Furthermore, a complete magnetic device such as a poleface magnet may be constructed as a high performance bulk magnetic component. Such devices may have either a unitary construction or they may be formed from a plurality of pieces which collectively form the completed device. Alternatively, a device may be a composite structure comprised entirely of ferromagnetic high saturation induction metal parts or a combination of high saturation induction metal parts with other magnetic materials.

A magnetic resonance (MRI) imaging device frequently employs a magnetic pole piece (also called a pole face) as part of a magnetic field generating means. As is known in the art, such a field generating means is used to provide a steady magnetic field and a time-varying magnetic field gradient superimposed thereon. In order to produce a high-quality, high-resolution MRI image it is essential that the steady field be homogeneous over the entire sample volume to be studied and that the field gradient be well defined. This homogeneity can be enhanced by use of suitable pole pieces. The bulk metal magnetic component described herein is suitable for use in constructing such a pole face.

The pole pieces for an MRI or other magnet system are adapted to shape and direct in a predetermined way the magnetic flux which results from at least one source of magnetomotive force (mmf). The source may comprise known mmf generating means, including permanent magnets and electromagnets with either normally conductive or superconducting windings. Each pole piece may comprise one or more bulk high performance metal magnetic components as described herein.

It is desirable for a pole piece to exhibit good DC magnetic properties including high permeability and high saturation flux density. Requirements for increased resolution and higher operating flux density in MRI systems have imposed a further requirement that the pole piece exhibit good AC magnetic properties. More specifically, the core loss produced in the pole piece by the time-varying gradient field must be minimized. Reducing the core loss advantageously improves the definition of the magnetic field gradient and allows the field gradient to be varied more rapidly, thus allowing reduced imaging time without compromising image quality.

There is a need for further improvements in pole pieces which exhibit not only the required DC properties but also substantially improved AC properties; the most important property being lower core loss. As explained below, the requisite combination of high magnetic flux density, high magnetic permeability, and low core loss is afforded by use of the disclosed magnetic component in the construction of pole pieces.

Figure 1B:
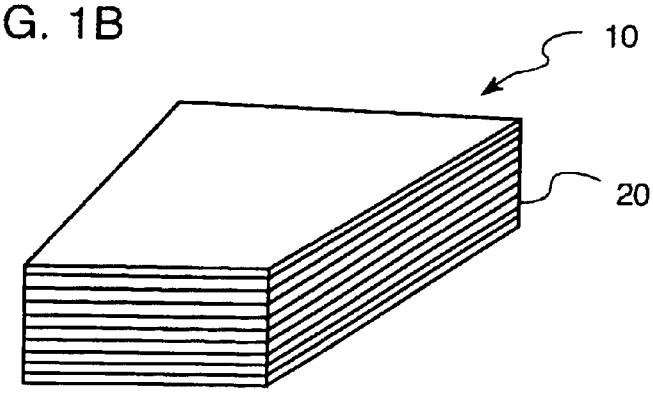
FIG. 1B is a perspective view of a high performance, bulk, high saturation induction metal magnetic component having the shape of a generally trapezoidal polyhedron constructed in accordance with the present invention.
Figure 1C:
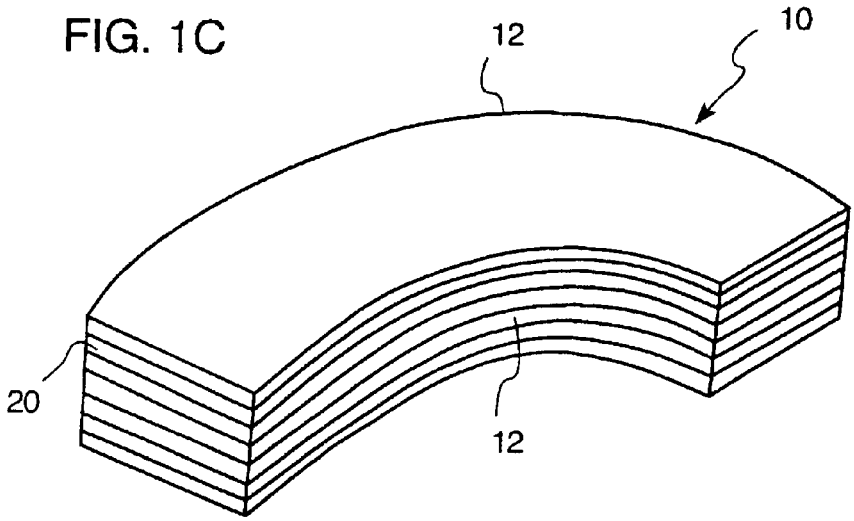
FIG. 1C is a perspective view of a high performance, bulk, high saturation induction metal magnetic component having the shape of a polyhedron with oppositely disposed arcuate surfaces and constructed in accordance with the present invention.

Referring now to FIGS. 1A to 1C in detail, FIG. 1A illustrates an implementation of a high performance, bulk ferromagnetic iron metal magnetic component 10 having a three-dimensional generally rectangular shape. The magnetic component 10 includes a plurality of substantially similarly shaped layers of ferromagnetic high saturation induction metal strip material 20 that are laminated together by adhesive bonding. The magnetic component depicted in FIG. 1B has a three-dimensional generally trapezoidal shape and includes a plurality of layers of ferromagnetic high saturation induction metal strip material 20 that are each substantially the same size and shape and that are laminated together by adhesive bonding. The magnetic component depicted in FIG. 1C includes two oppositely disposed arcuate surfaces 12. The component 10 is constructed of a plurality of substantially similarly shaped layers of ferromagnetic high saturation induction metal strip material 20 that are laminated together by adhesive bonding.

Implementations of the bulk metal magnetic component 10 are generally three-dimensional polyhedrons, and their shapes may include a generally rectangular, square or trapezoidal prism. Alternatively, and as depicted in FIG. 1C, the component 10 may have at least one arcuate surface 12, and as shown may include two arcuate surfaces 12 disposed opposite each other. The shapes shown in FIGS. 1A to 1C are exemplary only, and the aspect ratio of the height to width to length or arc length of such components may vary widely depending on the application.

A three-dimensional magnetic component 10 constructed in accordance with the present invention exhibits low core loss. When excited at an excitation frequency "f" to a peak induction level "$B_{max}$" it may have a core loss at room temperature of less than "L" wherein L is given by the formula $L=0.0135\ f\ (B_{max})^{1.9}+0.000108\ f^{1.6}\ (B_{max})^{1.92}$, the core loss, the excitation frequency and the peak induction level being measured in watts per kilogram, hertz, and teslas, respectively. In another embodiment, the magnetic component may have (i) a core-loss of less than or approximately equal to 1 watt-per-kilogram of magnetic material when operated at a frequency of approximately 60 Hz and at a flux density of approximately 1.0 Tesla (T); (ii) a core-loss of less than or approximately equal to 20 watts-per-kilogram of magnetic material when operated at a frequency of approximately 1000 Hz and at a flux density of approximately 1.0 T, or (iii) a core-loss of less than or approximately equal to 105 watt-per-kilogram of magnetic metal material when operated at a frequency of approximately 20,000 Hz and at a flux density of approximately 0.30 T. The reduced core loss of the component advantageously improves the efficiency of an electrical device that incorporates such components.

The low values of core loss make the bulk magnetic component especially suited for applications wherein the component is subjected to a high frequency magnetic excitation, e.g., excitation occurring at a frequency of at least about 100 Hz. The inherent high core loss of conventional steels at high frequency renders them unsuitable for use in devices requiring such high frequency excitations. These core loss performance values apply to the various embodiments described herein, regardless of the specific geometry of the bulk metal component.

Figure 2:
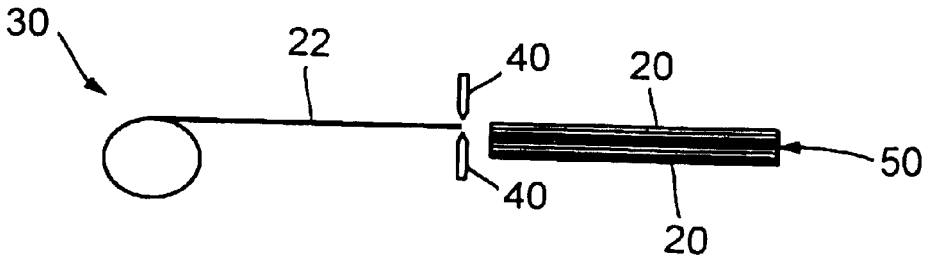
FIG. 2 is a side view of a coil of ferromagnetic high saturation induction metal strip positioned to be cut and stacked in accordance with the present invention.
Figure 3:
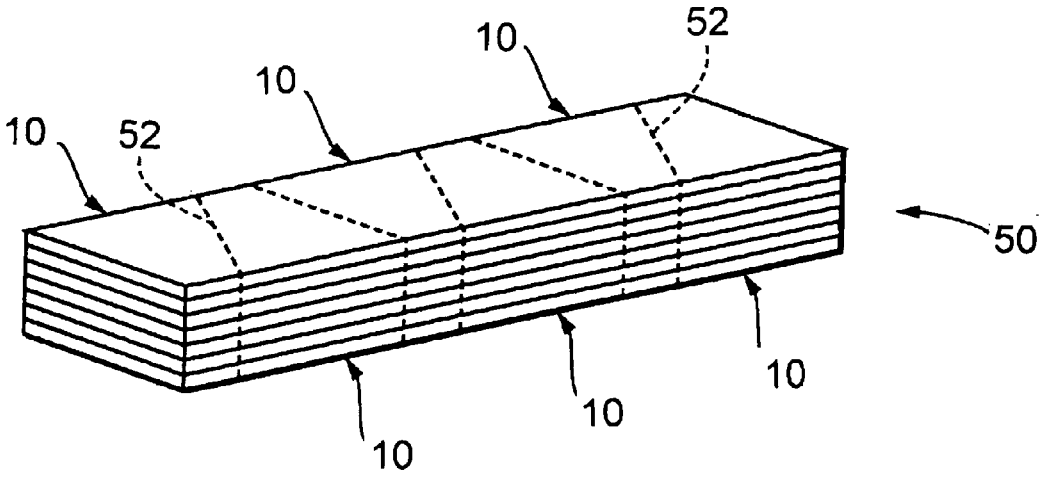
FIG. 3 is a perspective view of a bar of ferromagnetic high saturation induction metal strips showing the cut lines to produce a plurality of generally trapezoidally-shaped magnetic components in accordance with an implementation of the present invention.

The present invention also provides a method of constructing a bulk high performance metal magnetic component. As shown in FIG. 2, a roll 30 of ferromagnetic high saturation induction metal strip material is cut into a plurality of strips 20 having the same shape and size using, for example, cutting blades 40. The strips 20 are stacked to form a bar 50 of stacked high saturation induction metal strip material. The bar 50 is impregnated with an epoxy resin and cured to adhesively bond together the strips. The bar 50 can be cut along the lines 52 depicted in FIG. 3 to produce a plurality of generally three-dimensional parts having a generally rectangular, square or trapezoidal prism shape. The cutting means may alternately be a cutting wheel, a water jet, an electro-chemical grinding machine, and an electro-discharge machine or other suitable device. Alternatively, the component 10 may include at least one arcuate surface 12, as shown in FIG. 1C.

Figure 4:
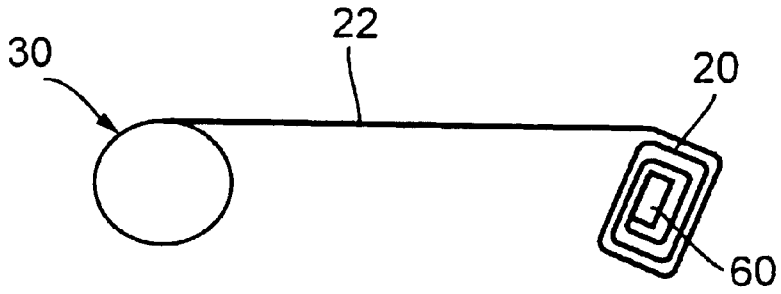
FIG. 4 is a side view of a coil of ferromagnetic high saturation induction metal strip which is being wound about a mandrel to form a generally rectangular core in accordance with an implementation of the present invention.
Figure 5:
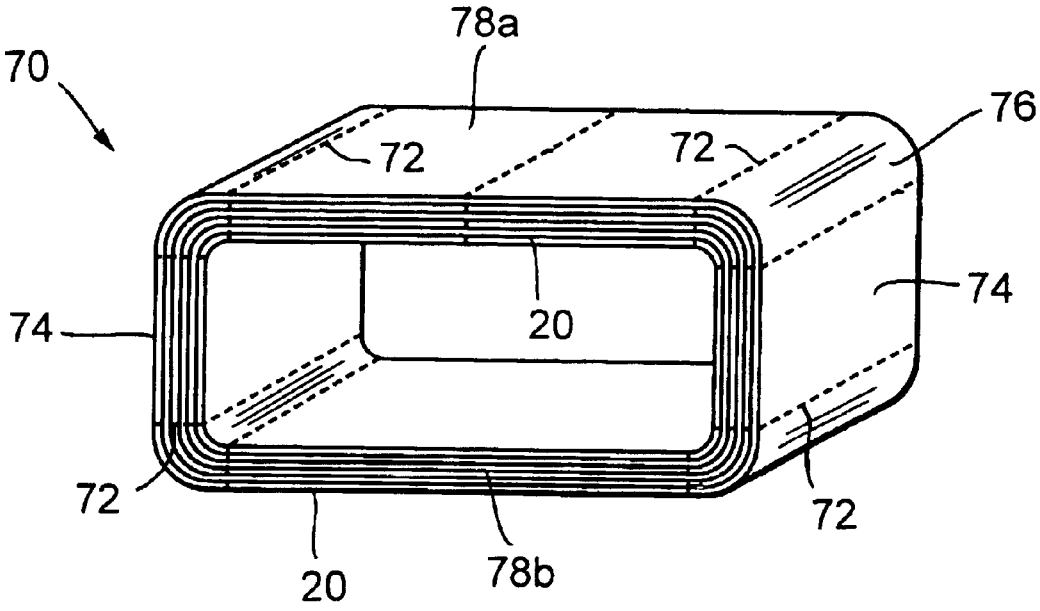
FIG. 5 is a perspective view of a generally rectangular ferromagnetic high saturation induction metal core formed in accordance with an implementation of the present invention.

In another implementation, shown in FIGS. 4 and 5, a bulk high saturation induction metal magnetic component 10 is formed by winding a single ferromagnetic high saturation induction metal strip 22 or a group of ferromagnetic high saturation induction metal strips 22 around a generally rectangular mandrel 60 to form a generally rectangular wound core 70. The height of the short sides 74 of the core 70 is preferably approximately equal to the desired length of the finished bulk high saturation induction metal magnetic component 10. The core 70 is impregnated with an epoxy resin and cured to adhesively bond together the layers of the core. Two components 10 may be formed by cutting the short sides 74, leaving the radiused corners 76 connected to the long sides 78*a* and 78*b*. Additional magnetic components 10 may be formed by removing the radiused corners 76 from the long sides 78*a* and 78*b*, and cutting the long sides 78*a* and 78*b* at a plurality of locations, indicated by the dashed lines 72. In the example illustrated in FIG. 5, the bulk high saturation induction metal component 10 has a generally three-dimensional rectangular shape, although other three-dimensional shapes are contemplated, for example, shapes having at least one trapezoidal or square face.

The bulk high saturation induction metal magnetic component 10 can be cut from bars 50 of stacked ferromagnetic high saturation induction metal strip or from cores 70 of wound ferromagnetic high saturation induction metal strip using many different cutting technologies. The component 10 may be cut from the bar 50 or core 70 using a cutting blade or wheel. Alternately, the component 10 may be cut by electro-discharge machining, electro-chemical grinding, or with a water jet or other suitable cutting device.

Figure 6A:
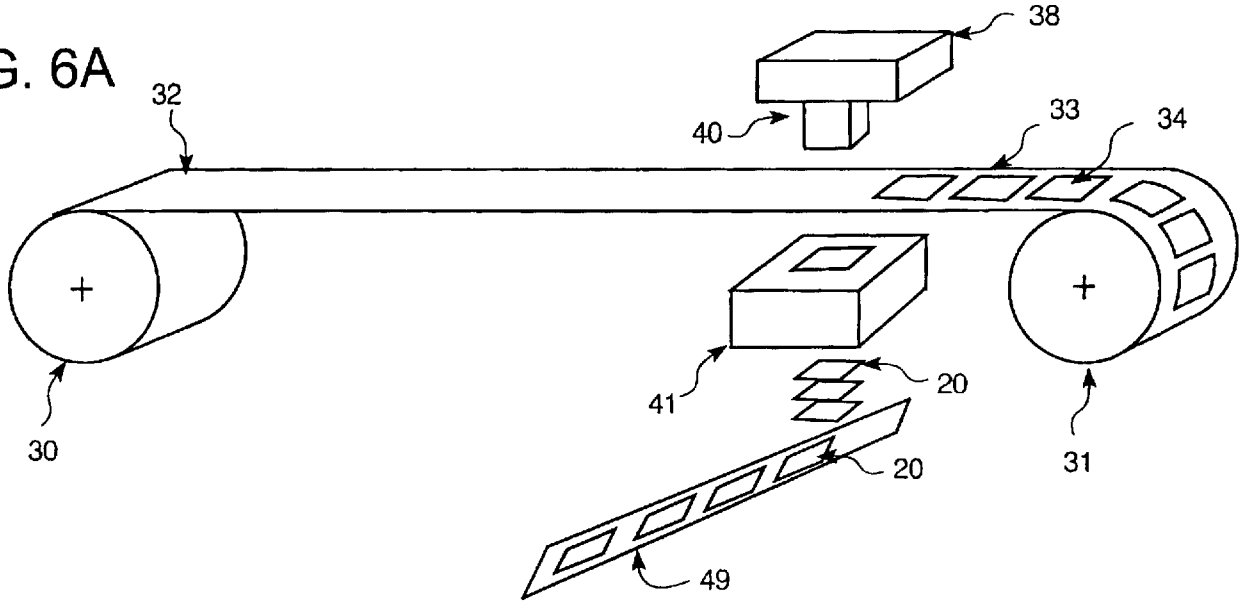
FIG. 6A is a side view of a coil of ferromagnetic high saturation induction metal strip positioned to be stamped, and of ferromagnetic high saturation induction metal laminations positioned to be collected in accordance with an implementation of the present invention.

Yet another embodiment for illustrating the method is shown in FIG. 6A. A high saturation induction metal strip is first annealed in an inert gas box oven (not shown) at a pre-selected temperature and for a pre-selected time sufficient to effect improvement of its magnetic properties and achieve a desired level of superlattice ordering of the alloy strip. The heat treated strip 32 is then fed from roll 30 into an automatic high-speed punch press 38 and between a punch 40 and an open-bottom die 41. The punch is driven into the die causing a lamination 20 of the required shape to be formed. Lamination 20 then falls or is transported out of die 41 into a collection device 49 and punch 40 is retracted. The collection device 49 may be a conveyor belt as shown in FIG. 2C, or may be a container or vessel 21 for collecting the laminations 20. A skeleton 33 of strip material 32 remains and contains holes 34 from which laminations 20 have been removed. Skeleton 33 is collected on takeup spool 31. After each punching action is accomplished, the strip 32 is indexed to prepare the strip for another punching cycle. The punching process is continued until a pre-selected number of laminations 20 are stamped and collected in a vessel, then the press cycle is stopped. One side of each lamination 20 may then be manually or automatically coated with an anaerobic adhesive and the laminations stacked in registry in an alignment fixture (not shown). The adhesive is allowed to cure. The now laminated stack 10 (see FIGS. 1A–1C) of laminations 20 is removed from the alignment fixture and the surface of stack 10 finished by removing any excess adhesive.

Figure 6B:
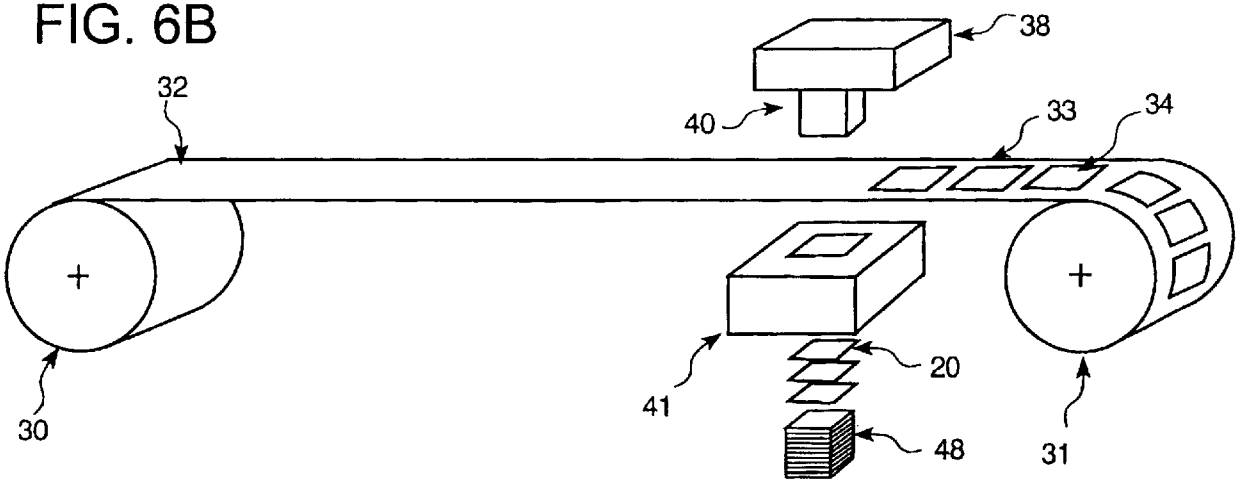
FIG. 6B is a side view of a coil of ferromagnetic high saturation induction metal strip positioned to be stamped, and of ferromagnetic high saturation induction metal laminations positioned to be stacked in accordance with an implementation of the present invention.

Still another embodiment is shown in FIG. 6B. A roll 30 of ferromagnetic metal strip material 32 is fed continuously into an automatic high-speed punch press 38 and between a punch 40 and an open-bottom die 41. The punch 40 is driven into the die 41 causing a lamination 20 of the required shape to be formed. Lamination 20 then falls into or is transported to a collecting magazine 48 and punch 40 is retracted. A skeleton 33 of strip material 32 remains and contains holes 34 from which laminations 20 have been removed. Skeleton 33 is collected on takeup spool 31. After each punching action is accomplished, the strip 32 is indexed to prepare the strip for another punching cycle. Strip material 32 may be fed into press 38 either in a single layer or in multiple layers (not illustrated), either from multiple payoffs or by prior pre-spooling of multiple layers. Use of multiple layers of strip material 32 advantageously reduces the number of punch strokes required to produce a given number of laminations 20. The punching process is continued and a plurality of laminations 20 are collected in magazine 48 in sufficiently well-aligned registry. After a requisite number of laminations 20 are punched and deposited into magazine 48, the operation of punch press 38 is interrupted. The requisite number may either be pre-selected or may be determined by the height or weight of laminations 20 received in magazine 48. Magazine 48 is then removed from punch press 38 for further processing. In an implementation, magazine 48 and laminations 20 contained therein are placed in an inert gas box oven (not shown) and heat-treated by heating them to a pre-selected temperature and holding them at that temperature for a pre-selected time sufficient to effect improvement of its magnetic properties by relieving residual stresses in the alloy. The magazine and laminations are then cooled to ambient temperature. A low-viscosity, heat-activated epoxy (not shown) is allowed to infiltrate the spaces between laminations 20 which are maintained in registry by the walls of magazine 48. Epoxy is then activated by placing the entire magazine 48 and laminations 20 contained therein in a curing oven for a time sufficient to effect the cure of the epoxy. The now laminated stack 10 (see FIGS. 1A–1C) of laminations 20 is removed and the surface of stack 10 finished by removing any excess epoxy. After cutting, stamping and laminating, an optional finishing step may be accomplished to finish the component. Such a finishing operation may include removing excess adhesive, giving the component a suitable surface finish, and/or giving the component its desired component dimensions.

Figure 7:
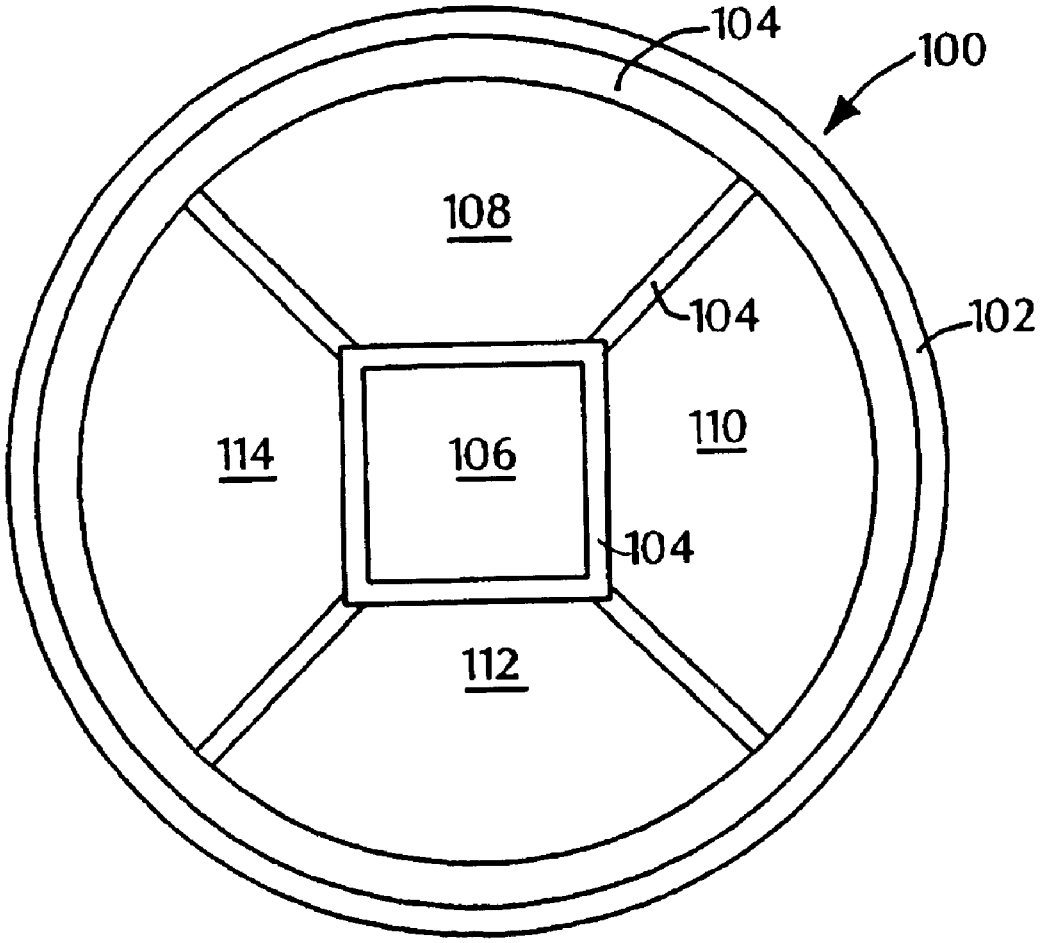
FIG. 7 is a plan view of a poleface magnet comprising high performance bulk magnetic metal components constructed in accordance with the present invention.

The present invention also provides a poleface magnet comprising at least one high performance bulk magnetic component. Referring now to FIG. 7 there is shown an implementation of a poleface magnet 100 comprising a plurality of bulk high performance magnetic components. In this implementation, a generally cylindrical poleface magnet 100 is assembled by placing the components in a cylindrical non-magnetic housing 102 in a predetermined alignment, filling the housing and the gaps between components with an epoxy potting compound 104, and curing the assembly. Alternately, a housing may not be required. In the illustrated implementations, the poleface magnet 100 includes a central bulk high performance magnetic component 106 which is approximately a square prismatic shape and four subordinate peripheral components, 108, 110, 112 and 114. The outside surface of each peripheral component 108, 110, 112 and 114 is approximately a 90 degree arcuate segment, so that the poleface magnet 100 assumes a substantially circular shape when constructed as shown.

A number of crystalline ferromagnetic alloys having a combination of high saturation induction, high magnetic permeability, and low core loss may be used in constructing the high performance, bulk metal magnetic component of the invention. The alloy may be an iron-base alloy having high silicon of 4–11%. Alloy containing 6–7% Si may be more suitable for some applications. Fe—Ni base alloys of Fe—Ni with 35–70% nickel and saturation induction greater than 1.2 T may also be suitable. The saturation induction values of Fe—Ni alloys with 45–55% Ni are especially high, e.g. over 1.5 T. Alloys of Fe—Co with have very high saturation induction but tend to have higher core loss than either Fe—Ni or Fe—Si alloys. Fe—Si—Al alloys such as Sendust have lower saturation induction (e.g. about 1.2 T) but advantageously have very low magnetostriction, low core loss, and high permeability.

The layers of strip material optionally may have an insulative coating to further reduce their eddy current losses. Phosphate or other inorganic or organic coatings known in the electrical art may be suitable for such an application.

A suitable alloy for use in fabricating three-dimensional high performance bulk metal magnetic components is ferromagnetic at the temperature at which the component is to be used. A ferromagnetic material is one which exhibits strong, long-range coupling and spatial alignment of the magnetic moments of its constituent atoms at a temperature below a characteristic temperature (generally termed the Curie temperature) of the material. It is preferred that the Curie temperature of material to be used in a device operating at room temperature be at least about 200° C. and preferably at least about 375° C. Devices may be operated at other temperatures, including down to cryogenic temperatures or at elevated temperatures, if the material to be incorporated therein has an appropriate Curie temperature.

A ferromagnetic material may further be characterized by its saturation induction or equivalently, by its saturation flux density or magnetization. The alloy described herein as suitable has a saturation induction of at least about 1.2 tesla (T) and, more suitably, a saturation induction of at least about 1.5 T. To promote low eddy current losses, the alloy also has high electrical resistivity, which may be at least about 30 $\mu\Omega$-cm.

The ferromagnetic material may be formed by using a chemical vapor deposition (CVD) process to produce a high quality ferromagnetic strip. For example, sheets of high silicon content Fe-base alloys can be produced by subjecting steel strip to siliconization at temperatures between 1023° and 1200° centigrade by CVD in a non-oxidizing gas atmosphere containing $SiCl_4$, and then performing a diffusion treatment to diffuse Si uniformly through the steel strip. The resulting steel strip is then cooled and coiled and ready for use. Alternately, a rapid solidification process may be used to create a high silicon steel strip. For example, a high silicon steel melt is first prepared that may be in the range of about 4–11 percent weight silicon and may contain incidental impurities. Next, the high silicon steel melt is rapidly cooled (at a rate on the order of $10^3$ to $10^6$ centigrade per second) on a cooling substrate to about 400° C. to form the thin metal strip. The resulting metal strip material has been know to exhibit excellent magnetic properties.

Non-oriented, ferromagnetic high silicon iron alloys suitable for constructing the magnetic component have recently become available commercially, for example, the SuperE and SuperHF series of high silicon steel materials sold by Nippon Kokan. The former is a 6.5% Si steel alloy, the latter an alloy with a gradient of Si concentration through the strip thickness ranging from 6.5% Si at the surface to 4% at mid-strip. Both are sold as continuous strip material as thin as 0.05 mm with average saturation flux densities of 1.8 and 1.85 T, respectively.

Ternary Fe—Si—Al alloys such as Sendust may also be suitable for certain poleface applications because of their permeability and core loss. Alloys consisting essentially of 4–7% Al, 8–11% Si, and the balance Fe and incidental impurities may be suitable, with a composition of 5.5% Al and 9.5% Si being preferred. Known techniques for preparing Fe—Si—Al alloy include rapid solidification, squeeze casting, and powder metallurgy.

An Fe—Ni alloy having 45–55% Ni suitable for the invention is sold by National Arnold under the tradename DeltaMax. In general, round-loop versions of the Fe—Ni alloys are preferred, since they exhibit lower core losses than versions processed to give high B-H loop squareness.

In the construction of the bulk magnetic metal component, adhesive bonding means may be used to adhere a plurality of layers of metal material to each other, thereby giving the component sufficient structural integrity for handling, use, or incorporation into a larger structure. The adhesive means may effect adherence of only a portion of the surfaces of adjacent metal layers, such as a portion near the periphery thereof. Alternatively the adhesive means may effect adherence of at least 50% of the area of the adjacent layers, and more suitably, substantially all the area.

The adhesive bonding means generally includes use of an adhesive. A variety of adhesives may be suitable, including epoxies, varnishes, anaerobic adhesives, and room-temperature-vulcanized (RTV) silicone materials. Adhesives desirably have low viscosity, low shrinkage, low elastic modulus, high peel strength, and high dielectric strength. Epoxies may be either multi-part, whose curing is chemically activated, or single-part, whose curing is activated thermally or by exposure to ultra-violet radiation. Suitable methods for applying the adhesive include, but are not limited to, dipping, spraying, brushing, and electrostatic deposition. In strip or ribbon form metal may also be coated by passing it over rods or rollers which transfer adhesive to the metal. Rollers or rods having a textured surface, such as gravure or wire-wrapped rollers, are especially effective in transferring a uniform coating of adhesive onto the metal. The adhesive may be applied to individual layers of metal, one at a time. Alternatively, the adhesive means may be applied to all of the layers of metal collectively, after they have been stacked. In this case, the stack is impregnated by capillary flow of the adhesive between the laminations. The stack may be placed either in a vacuum or under hydrostatic pressure to effect more complete filling. Such procedures result in minimizing the total volume of adhesive added, thus resulting in a well-controlled, high stacking factor.

In another implementation of the method, the lamination of the layers of the component may be accomplished by overmolding stacked layers or by mechanically restraining the layers with bands or other similar means.

The bulk high saturation induction metal magnetic components described herein are especially suited for tiles for poleface magnets used in high performance MRI systems, in television and video systems, and in electron and ion beam systems. The disclosed techniques result in simplified magnetic component manufacturing and reduce manufacturing time. Stresses otherwise encountered during the construction of bulk high saturation induction metal components are minimized and magnetic performance of the finished components is optimized.

An electromagnet system comprising an electromagnet having one or more poleface magnets is commonly used to produce a time-varying magnetic field in the gap of the electromagnet. The time-varying magnetic field may be a purely AC field, i.e. a field whose time average value is zero. Optionally the time varying field may have a non-zero time average value conventionally denoted as the DC component of the field. In the electromagnet system, the at least one poleface magnet is subjected to the time-varying magnetic field. As a result the pole face magnet is magnetized and demagnetized with each excitation cycle. The time-varying magnetic flux density or induction within the poleface magnet causes the production of heat from core loss therein.

In the case of a pole face comprised of a plurality of bulk magnetic components, the total loss is a consequence both of the core loss which would be produced within each component if subjected in isolation to the same flux waveform and of the loss attendant to eddy currents circulating in paths which provide electric continuity between the components.

Bulk high performance magnetic components will magnetize and demagnetize more efficiently than components made from other conventional iron-base magnetic metals. When used as a pole magnet, the high performance, low loss metal component will generate less heat than a comparable component made from another iron-base magnetic metal when the two components are magnetized at identical induction and excitation frequency. Furthermore, a suitable ferromagnetic metal has a saturation induction of at least about 1.2 T and preferably at least about 1.7 T. High silicon iron alloy may have a saturation induction of up to about 1.8 T. Such saturation inductions are significantly higher than those of other low loss soft magnetic materials such as high Ni permalloy alloys, which are typically 0.6–0.9 T. The metal component can therefore be designed to operate 1) at a lower operating temperature; 2) at higher induction to achieve reduced size and weight; or, 3) at higher excitation frequency to achieve reduced size and weight, or to achieve superior signal resolution, when compared to magnetic components made from other conventional iron-base magnetic metals. The alloy strip is no more than 100 $\mu$m (0.004") thick and has an electrical resistivity of 30 $\mu\Omega$-cm or more. Commercial 50Ni—Fe alloys generally have saturation inductions of at least 1.5 T and resistivities of at least 30 $\mu\Omega$-cm. Preferably the alloy strip is composed of high silicon iron alloy no more than 50 $\mu$m (0.002") thick and with an electrical resistivity of 50–80 $\mu\Omega$-cm or more.

It has been recognized that eddy currents in pole pieces comprising elongated ferromagnetic rods may be reduced by electrically isolating those rods from each other by interposed electrically non-conducting material. The component disclosed herein affords a substantial further reduction in the total losses, because the use of the material and construction methods taught herein reduces the losses arising within each individual component from those which would be exhibited in a conventional component made with other materials or construction methods.

Core loss may be defined as that dissipation of energy which occurs within a ferromagnetic material as the magnetization thereof is changed with time. The core loss of a given magnetic component is generally determined by cyclically exciting the component. A time-varying magnetic field is applied to the component to produce therein a corresponding time variation of the magnetic induction or flux density. For the sake of standardization of measurement, the excitation is generally chosen such that the magnetic induction varies sinusoidally with time at a frequency "f" and with a peak amplitude "$B_{max}$." The core loss is then determined by known electrical measurement instrumentation and techniques. Loss is conventionally reported as watts per unit mass or volume of the magnetic material being excited. It is known that loss increases monotonically with f and $B_{max}$. Most standard protocols for testing the core loss of soft magnetic materials used in components of poleface magnets {e.g. ASTM Standards A912–93 and A927(A927M-94)} call for a sample of such materials which is situated in a substantially closed magnetic circuit, i.e. a configuration in which closed magnetic flux lines are completely contained within the volume of the sample. Such sample forms include tape-wound or punched toroids, single strips across a yoke, or stacked forms like Epstein frames.

In some cases the core loss behavior of the component described herein is best characterized by testing in a magnetically open circuit, i.e. a configuration in which magnetic flux lines must traverse an air gap. Such a test more closely simulates the behavior of the component when used in a circuit wherein one or more air gaps contribute a significant portion of the total circuit reluctance. In such cases, which may include some poleface configurations, fringing field effects and non-uniformity of the magnetic field may result in somewhat higher core losses, i.e. higher values of watts per unit mass or volume, than comparable material would show in a lower reluctance or closed circuit. The present bulk magnetic component advantageously exhibits low core loss over a wide range of flux densities and frequencies even in an open-circuit configuration.

Without being bound by any theory, it is believed that the total core loss of the presented low-loss bulk high saturation induction metal component includes contributions from hysteresis losses and eddy current losses. Each of these two contributions is a function of the peak magnetic induction $B_{max}$ and of the excitation frequency f. Prior art analyses of core losses in amorphous and high silicon iron metals (see, e.g., G. E. Fish, J. Appl. Phys. 57, 3569(1985) and G. E. Fish et al., J. Appl. Phys. 64, 5370(1988)) have generally been restricted to data obtained for material in a closed magnetic circuit.

The total core loss $L(B_{max}, f)$ per unit mass of the bulk magnetic component of the invention may be essentially defined by a function having the form $$L(B_{max}, f)=c_1 f(B_{max})^n+c_2 f^q(B_{max})^m$$

wherein the coefficients $c_1$ and $c_2$ and the exponents n, m, and q must all be determined empirically, there being no known theory that precisely determines their values. Use of this formula allows the total core loss of the present bulk magnetic component to be determined at any required operating induction and excitation frequency, not just at select test points.

A core loss equation such as that set forth above defines the required performance of the component of the invention. The parameters of this equation may be determined from a representative set of empirical test data points using numerical methods such as least squares fitting (also known as regression analysis). Known non-linear methods are required if the exponents n, m, and q are to be adjusted. Linear methods suffice if only $c_1$ and $c_2$ are to be determined.

Furthermore, it is generally found that in the particular geometry of a bulk magnetic component the magnetic field therein is not spatially uniform. Techniques such as finite element modeling are known to provide an estimate of the spatial and temporal variation of the peak flux density that closely approximates the flux density distribution measured in an actual bulk magnetic component. The core loss equation gives the loss of the given material under spatially uniform flux density excitation. The loss equation and the modeling may then be combined thus allowing the corresponding actual core loss of a given component in its operating configuration (with non-uniform flux density) to be predicted with reasonable accuracy.

The measurement of the core loss of the present magnetic component can be carried out using various methods known in the art, including the ASTM methods cited above. Another method suited for measuring the present component comprises forming a magnetic circuit with the present magnetic component and a flux closure structure means. In another method the magnetic circuit may comprise a plurality of magnetic components of the invention and a flux closure structure means. Generally stated, the flux closure structure means comprises soft magnetic material having high permeability and a saturation flux density at least equal to the flux density at which the component is to be tested. The soft magnetic material may have a saturation flux density at least equal to the saturation flux density of the component. The flux direction along which a component is to be tested generally defines first and second opposite faces of the component. Flux lines enter the component in a direction generally normal to the plane of the first opposite face. The flux lines generally follow the plane of the high saturation induction metal strips, and emerge from the second opposing face. The flux closure structure means generally comprises a flux closure magnetic component. Such a component could be constructed as taught herein, but may also be made with other methods and with known materials. The flux closure magnetic component also has first and second opposing faces through which flux lines enter and emerge, generally normal to the respective planes thereof. The flux closure component opposing faces are substantially the same size and shape as compared to the respective faces of the magnetic component to which the flux closure component is mated during actual testing. The flux closure magnetic component is placed in mating relationship with its first and second faces closely proximate and substantially proximate to the first and second faces of the present magnetic component, respectively. Magnetomotive force is applied by passing current through a first winding encircling either the present magnetic component or the flux closure magnetic component. The resulting flux density is determined by Faraday's law from the voltage induced in a second winding encircling the magnetic component to be tested. The applied magnetic field is determined by Ampère's law from the magnetomotive force. The core loss is then computed from the applied magnetic field and the resulting flux density by conventional methods.

Referring to FIG. 5, there is illustrated a component 10 having a core loss which can be readily determined by the testing method described hereinafter. For example, long side 78*b* of core 70 is appointed as magnetic component 10 for core loss testing. The remainder of core 70 serves as the flux closure structure means, which is generally C-shaped and comprises the four generally radiused corners 76, short sides 74 and long side 78*a*. Each of the cuts 72 which separate the radiused corners 76, the short sides 74, and long side 78*a* is optional. Generally, only the cuts separating long side 78*b* from the remainder of core 70 are made. Cut surfaces formed by cutting core 70 to remove long side 78*b* define the opposite faces of the magnetic component and the opposite faces of the flux closure magnetic component. For testing, long side 78*b* is situated with its faces closely proximate and parallel to the corresponding faces defined by the cuts. The faces of long side 78*b* are substantially the same in size and shape as the faces of the flux closure magnetic component. Two copper wire windings (not shown) encircle long side 78*b*. An alternating current of suitable magnitude is passed through the first winding to provide a magnetomotive force that excites long side 78*b* at the requisite frequency and peak flux density. Flux lines in long side 78*b* and the flux closure magnetic component are generally within the plane of strips 22 and directed circumferentially. Voltage indicative of the time varying flux density within long side 78*b* is induced in the second winding. Core loss is determined by conventional electronic means from the measured values of voltage and current.

Several implementations of a bulk magnetic component have been described, but it should be understood that various changes, additions and modifications could be made by one skilled in the art which fall within the spirit and scope of the appended claims.

What is claimed is:

1. A high performance, low core loss bulk magnetic component comprising a plurality of substantially similarly shaped layers of crystalline, ferromagnetic metal strips adhesively bonded together by an adhesive bonding means to form a laminated polyhedrally shaped part, wherein the ferromagnetic metal strips include an iron-base alloy containing 4–11 weight percent Si, and wherein said magnetic component when operated at an excitation frequency "f" to a peak induction level $B_{max}$ has a core-loss less than "L" wherein L is given by the formula $L=0.0135\ f(B_{max})^{1.9}+0.000108\ f^{1.6}\ (B_{max})^{1.92}$, said core loss, said excitation frequency and said peak induction level being measured in watts per kilogram, hertz, and teslas, respectively.

2. A high performance bulk magnetic component as recited by claim 1, wherein the ferromagnetic metal strips have a composition containing 6–7 weight percent Si.

3. A high performance bulk magnetic component as recited by claim 1, wherein the ferromagnetic metal strips have a composition containing 8–11 weight percent Si and 4–7 weight percent Al.

4. A high performance bulk magnetic component as recited by claim 1, wherein the ferromagnetic metal strips are produced by a process comprising rapid solidification.

5. A high performance bulk magnetic component as recited by claim 1, wherein the ferromagnetic metal strips are produced by a process comprising chemical vapor deposition and diffusion of Si.

6. A high performance bulk magnetic component as recited by claim 1, each of said ferromagnetic metal strips having a saturation induction of at least about 1.7 T.

7. A high performance bulk magnetic component as recited by claim 1, wherein the component has the shape of at least one of a three-dimensional polyhedron with at least one rectangular cross-section, a three-dimensional polyhedron with at least one trapezoidal cross-section, and a three-dimensional polyhedron with at least one square cross-section.

8. A high performance bulk magnetic component as recited by claim 1, wherein the component includes at least one arcuate surface.

9. A high performance bulk magnetic component as recited by claim 1, wherein the magnetic component has a core-loss of less than or approximately equal to 1 watt-per-kilogram of magnetic metal material when operated at a frequency of approximately 60 Hz and at a flux density of approximately 1.0 T.

10. A high performance bulk magnetic component as recited by claim 1, wherein said magnetic component has a core-loss of less than or approximately equal to 20 watts-per-kilogram of magnetic metal material when operated at a frequency of approximately 1,000 Hz and at a flux density of approximately 1.0 T.

11. A high performance bulk magnetic component as recited by claim 1, wherein said magnetic component has a core-loss of less than or approximately equal to 105 watts-per-kilogram of magnetic metal material when operated at a frequency of approximately 20,000 Hz and at a flux density of approximately 0.30 T.

12. A high performance bulk magnetic component as recited by claim 1, said adhesive bonding means including at least one adhesive selected from the group consisting of epoxies, varnishes, anaerobic adhesives, and room-temperature-vulcanized (RTV) silicone materials.

13. A high performance, low core loss bulk magnetic component comprising a plurality of substantially similarly shaped layers of crystalline, ferromagnetic metal strips adhesively bonded together by an adhesive bonding means to form a laminated polyhedrally shaped part, wherein the ferromagnetic metal strips include an Fe—Ni base alloy containing 35–70 weight percent Ni, and wherein said magnetic component when operated at an excitation frequency "f" to a peak induction level $B_{max}$ has a core-loss less than "L" wherein L is given by the formula $L=0.0135\ f(B_{max})^{1.9}+0.000108\ f^{1.6}\ (B_{max})^{1.92}$, said core loss, said excitation frequency and said peak induction level being measured in watts per kilogram, hertz, and teslas, respectively.

14. A high performance bulk magnetic component as recited by claim 13, wherein the ferromagnetic metal strips have a composition with 45–55 weight percent Ni.

15. A high performance bulk magnetic component as recited by claim 13, each of said ferromagnetic metal strips having a saturation induction of at least about 1.2 T.

16. A high performance bulk magnetic component as recited by claim 13, wherein the component has the shape of at least one of a three-dimensional polyhedron with at least one rectangular cross-section, a three-dimensional polyhedron with at least one trapezoidal cross-section, and a three-dimensional polyhedron with at least one square cross-section.

17. A high performance bulk magnetic component as recited by claim 13, wherein the component includes at least one arcuate surface.

18. A high performance bulk magnetic component as recited by claim 13, wherein the magnetic component has a core-loss of less than or approximately equal to 1 watt-per-kilogram of magnetic metal material when operated at a frequency of approximately 60 Hz and at a flux density of approximately 1.0 T.

19. A high performance bulk magnetic component as recited by claim 13, wherein said magnetic component has a core-loss of less than or approximately equal to 20 watts-per-kilogram of magnetic metal material when operated at a frequency of approximately 1,000 Hz and at a flux density of approximately 1.0 T.

20. A high performance bulk magnetic component as recited by claim 13, wherein said magnetic component has a core-loss of less than or approximately equal to 105 watts-per-kilogram of magnetic metal material when operated at a frequency of approximately 20,000 Hz and at a flux density of approximately 0.30 T.

21. A high performance bulk magnetic component as recited by claim 13, said adhesive bonding means including at least one adhesive selected from the group consisting of epoxies, varnishes, anaerobic adhesives, and room-temperature-vulcanized (RTV) silicone materials.

22. A high performance poleface magnet comprising at least one magnetic component, each magnetic component including a plurality of substantially similarly shaped layers of crystalline, ferromagnetic metal strips bonded together by an adhesive bonding means to form a polyhedrally shaped part wherein said magnetic component when operated at an excitation frequency "f" to a peak induction level $B_{max}$ has a core-loss less than "L" wherein L is given by the formula $L=0.0135\ f(B_{max})^{1.9}+0.000108\ f^{1.6}\ (B_{max})^{1.92}$, said core loss, said excitation frequency and said peak induction level being measured in watts per kilogram, hertz, and teslas, respectively.

23. A high performance poleface magnet comprising at least one magnetic component, each magnetic component including a plurality of substantially similarly shaped layers of crystalline, ferromagnetic metal strips bonded together by an adhesive bonding means to form a polyhedrally shaped part, wherein the ferromagnetic metal strips include an iron base alloy containing 4–11 weight percent Si, and wherein said magnetic component when operated at an excitation frequency "f" to a peak induction level $B_{max}$ has a core-loss less than "L" wherein L is given by the formula $L=0.0135\ f\ (B_{max})^{1.9}+0.000108\ f^{1.6}\ (B_{max})^{1.92}$, said core loss, said excitation frequency and said peak induction level being measured in watts per kilogram, hertz, and teslas, respectively.

24. A high performance poleface magnet as recited in claim 23, wherein the ferromagnetic metal strips have a composition containing 6–7 weight percent Si.

25. A high performance poleface magnet as recited in claim 23, wherein the ferromagnetic metal strips have a composition containing 8–11 weight percent Si and 4–7 weight percent Al.

26. A high performance poleface magnet comprising at least one magnetic component, each magnetic component including a plurality of substantially similarly shaped layers of crystalline, ferromagnetic metal strips bonded together by an adhesive bonding means to form a polyhedrally shaped part, wherein the ferromagnetic metal strips include an Fe—Ni base alloy containing 35–70 weight percent Ni, and wherein said magnetic component when operated at an excitation frequency "f" to a peak induction level $B_{max}$ has a core-loss less than "L" wherein L is given by the formula $L=0.0135\ f\ (B_{max})^{1.9}+0.000108\ f^{1.6}\ (B_{max})^{1.92}$, said core loss, said excitation frequency and said peak induction level being measured in watts per kilogram, hertz, and teslas, respectively.

27. A high performance poleface magnet as recited in claim 26, wherein the ferromagnetic metal strips have a composition containing 45–55 weight percent Ni.

* * * * *